United States Patent [19]

Gano

[11] 3,954,196

[45] May 4, 1976

[54] MATERIAL HANDLING APPARATUS

[75] Inventor: John W. Gano, New Philadelphia, Ohio

[73] Assignee: The Warner & Swasey Company, Cleveland, Ohio

[22] Filed: Oct. 15, 1974

[21] Appl. No.: 514,598

[52] U.S. Cl. ..... 214/141; 212/55

[51] Int. Cl.[2] ..... E02F 3/38

[58] Field of Search ..... 214/141, 138 R; 37/117.5, 118; 212/54, 55, 58, 59

[56] References Cited

UNITED STATES PATENTS

| | | | |
|---|---|---|---|
| 3,214,040 | 10/1965 | Willinger | 214/138 R |
| 3,329,291 | 7/1967 | Przybylski | 214/141 |
| 3,386,295 | 6/1968 | Tomlinson | 214/141 |
| 3,460,691 | 8/1969 | Wieger et al. | 214/141 |
| 3,700,126 | 10/1972 | Beaton | 214/141 |
| 3,803,925 | 4/1974 | Jackson | 214/138 R |
| 3,871,538 | 3/1975 | Miller et al. | 214/141 |

*Primary Examiner*—Robert J. Spar
*Assistant Examiner*—Ross Weaver

[57] ABSTRACT

An improved material handling apparatus includes a base boom section which is rotatably supported in a cradle and a second boom section which is telescopically received within the base boom section and is movable axially relative to the base boom section. A force transmitting assembly is provided to transmit rotational drive forces from a tilt motor to the base boom section to effect rotational movement of the two boom sections about their longitudinal axes. This force transmitting assembly also retains the base boom section against axial and radial movement relative to the cradle. The force transmitting assembly includes a single force transmitting member or body which is fixedly connected at one end portion to an end wall of the base boom section and is rotatably supported by a cradle mounted thrust bearing assembly. The thrust bearing assembly holds the single force transmitting member against axial movement to thereby retain the base boom section against axial movement. A gear segment on the force transmitting member cooperates with a gear connected to the tilt motor which is disposed between an end wall of the base boom section and the cradle. Upon operation of the tilt motor, the force transmitting member rotates the two boom sections relative to the cradle. The force transmitting member is provided with fluid passages and manifold rings which conduct fluid to effect operation of another motor to extend and retract the two boom sections.

8 Claims, 5 Drawing Figures

MATERIAL HANDLING APPARATUS

BACKGROUND OF THE INVENTION

This invention relates generally to a material handling apparatus and more specifically to a material handling apparatus having at least one rotatable boom section.

One known material handling apparatus includes a base boom section which is mounted on a cradle for rotational or tilt movement about a central longitudinal axis of the boom section. A trunnion type bearing assembly is provided between the end wall of the base boom section and the cradle to permit rotation of the base boom section in the cradle and to retain the base boom section against axial movement relative to the cradle. This known material handling apparatus includes a hydraulic motor which is connected to the front of the cradle to drive a gear segment carried by the base boom section. A fluid passage arrangement has been provided in association with the trunnion bearing between the end wall of the cradle and the end wall of the base boom section to conduct hydraulic fluid to the piston and cylinder assembly for moving the inner boom section relative to the base boom section.

There are many other known types of material handling devices having rotatable boom sections. Some of these known devices are disclosed in U.S. Pat. Nos. 3,700,126; 3,224,608; 3,042,234; and 2,541,045. In addition to these prior art material handling devices, a material handling apparatus having a base boom section which is rotated under the influence of a cradle mounted tilt motor is disclosed in copending application Ser. No. 512,249 filed Oct. 4, 1974 by John W. Gano and entitled "Material Handling Apparatus". Although these known material handling devices have been more or less satisfactory in their operation, it is desirable to reduce the cost of manufacturing of these material handling devices as much as possible, particularly when they are to be subjected to relatively light operating loads.

SUMMARY OF THE PRESENT INVENTION

The present invention provides a new and improved material handling apparatus which is relatively inexpensive to construct and reliable in its mode of operation. This material handling apparatus includes a boom assembly having a rotatable base boom section in which a second boom section is telescopically received so that both boom sections are simultaneously rotated about their common central axes by a tilt or rotational drive motor. Drive forces are transmitted from the tilt motor to the base boom section by a force transmitting assembly which is also effective to retain the base boom section against axial movement relative to a cradle which supports the boom assembly. This force transmitting assembly includes a single member which transmits axial and radial thrust forces and rotational drive forces.

The single force transmitting member is fixedly connected at one end to an inner end wall of the base boom section and is rotatably mounted at its opposite end on a cradle mounted thrust bearing. The piston and cylinder type tilt motor is disposed between the end wall of the base boom section and the cradle. The tilt motor is operable to rotate the single force transmitting member to thereby rotate the base boom section. The single force transmitting member is provided with internal passages to direct fluid for effecting operation of another motor to move the second boom section telescopically in and out relative to the base boom section to thereby vary the overall length of the boom assembly.

Accordingly, it is an object of this invention to provide a new and improved material handling apparatus wherein a force transmitting assembly is disposed between an inner end portion of a base boom section and a cradle to transmit rotational drive forces from a motor to the base boom section and to retain the base boom section against axial movement relative to the cradle and wherein the force transmitting assembly includes a single member which transmits both axial thrust forces and rotational drive forces.

Another object of this invention is to provide a new and improved material handling apparatus which includes a boom assembly having a base boom section which is rotatably supported by a cradle and is rotated about its central axis under the influence of a tilt motor disposed between the end of the base boom section and an end portion of the cradle, a second boom section being movable axially relative to the base boom section by another motor which transmits axial thrust forces between the cradle and second boom section independently of the base boom section.

BRIEF DESCRIPTION OF THE DRAWINGS

The foregoing and other objects and features of the present invention will become more apparent upon a consideration of the following description taken in connection with the accompanying drawings wherein.

Description of One Specific Preferred Embodiment of the Invention

Figure 1:
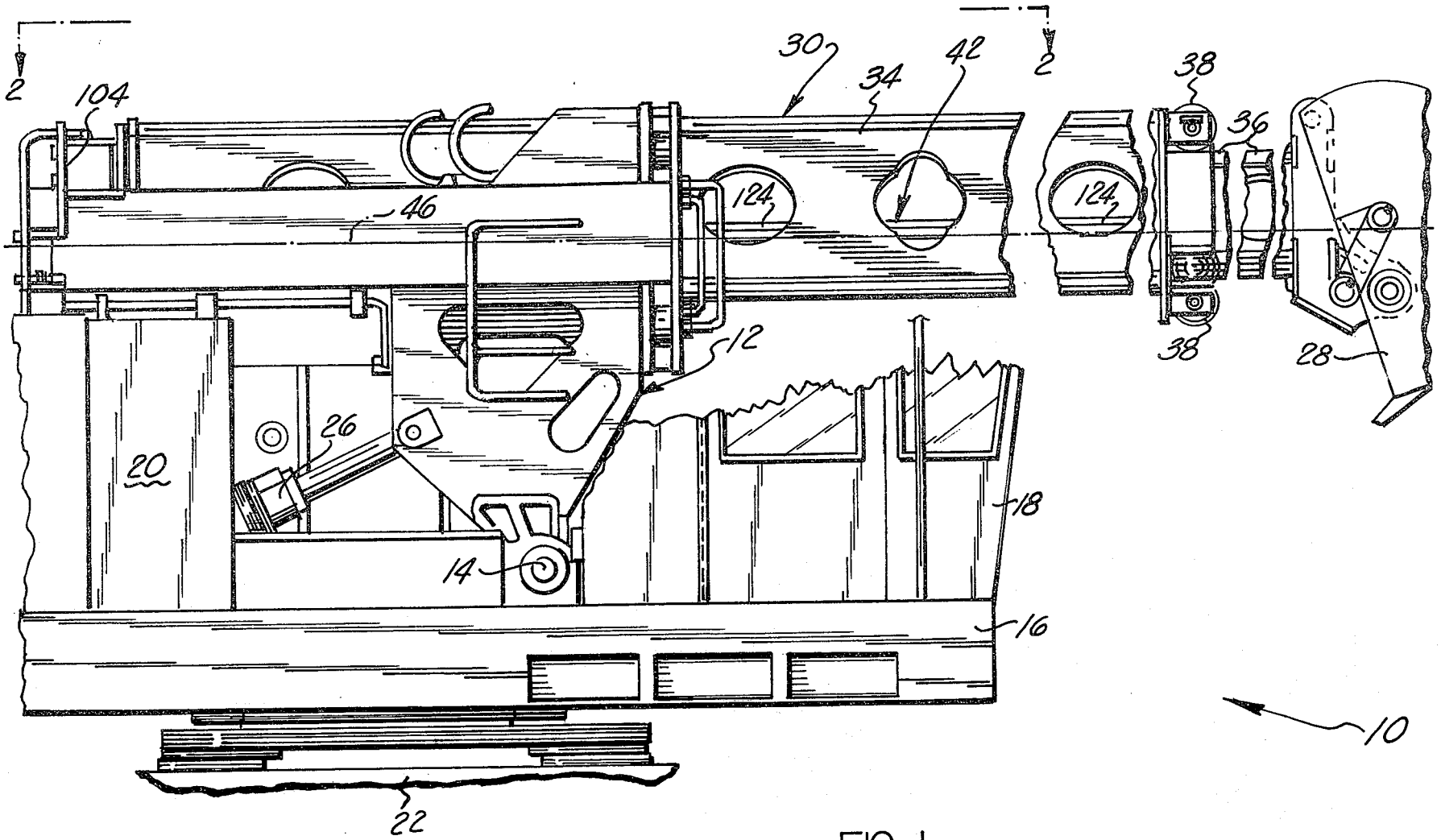
FIG. 1 is an elevational view of a material handling apparatus constructed in accordance with the present invention.

An improved material handling assembly 10 constructed in accordance with the present invention is illustrated in FIG. 1 and includes a cradle 12 which is pivotally mounted at 14 on a rotatable base 16 which also supports an operator's cab 18 and a pump and motor assembly 20. The base 16 is rotatably connected with a suitable support structure 22. A piston and cylinder type motor 26 is extensible and retractable to pivot the cradle 12 about the pivot connection 14 to thereby raise and lower a suitable tool 28 connected with a cradle mounted boom assembly 30.

The boom assembly 30 includes a base or first boom section 34 which is rotatably received within a longitudinally extending cavity in the cradle 12. A second boom section 36 is telescopically received within the first boom section and is supported for axial movement relative to the first boom section by rollers 38. A first or boom extension motor 42 is of the piston and cylinder type and is operable to effect axial movement of the second boom section 36 relative to the base boom section 34 to vary the telescopic relationship between the two boom sections and thereby move the tool or bucket 28 toward and away from the cradle 12. It should be noted that the extension motor 42 is of the piston and cylinder type and has a longitudinally extending central axis which is coincident with a longitudinally extending central axis 46 of the two boom sections 34 and 36.

Figure 2:
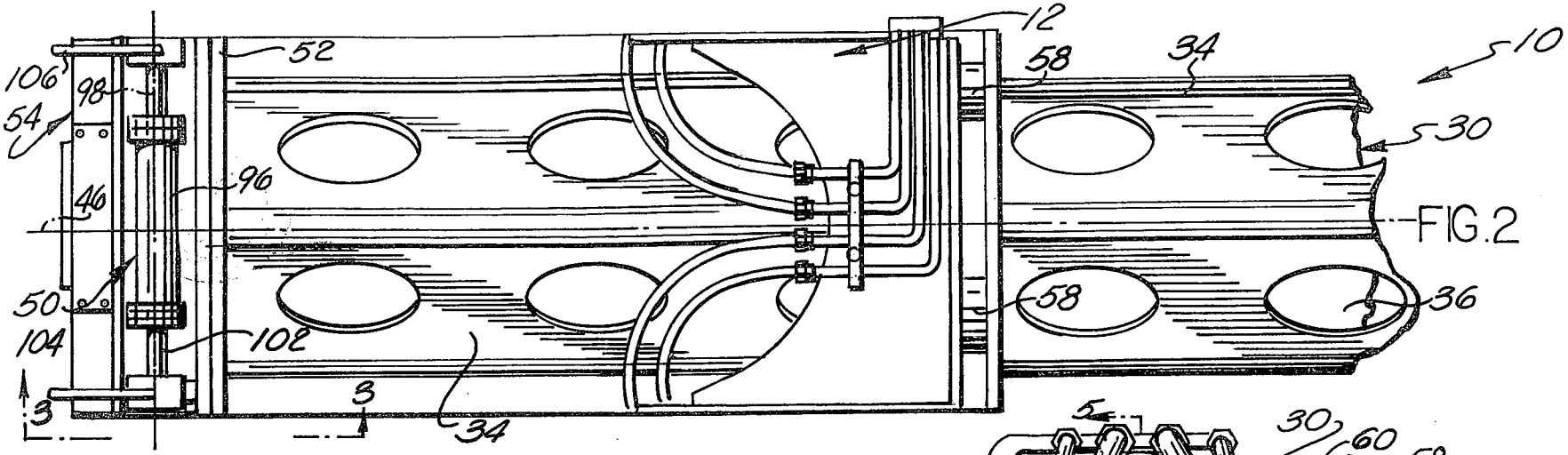
FIG. 2 is a plan view, taken generally along the line 2—2 of FIG. 1, illustrating the relationship between a base boom section, cradle, and a tilt motor for rotating the base boom section relative to the cradle.
Figure 4:
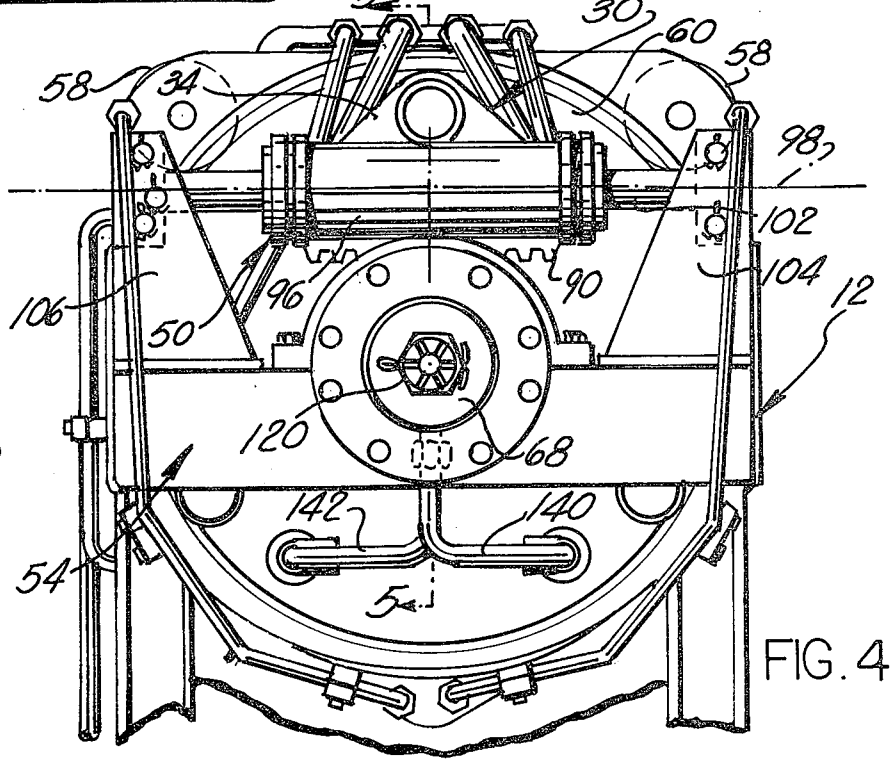
FIG. 4 is an end view, taken generally along the line 4—4 of FIG. 3, depicting the relationship between the tilt motor, the base boom section and the cradle.
Figure 3:
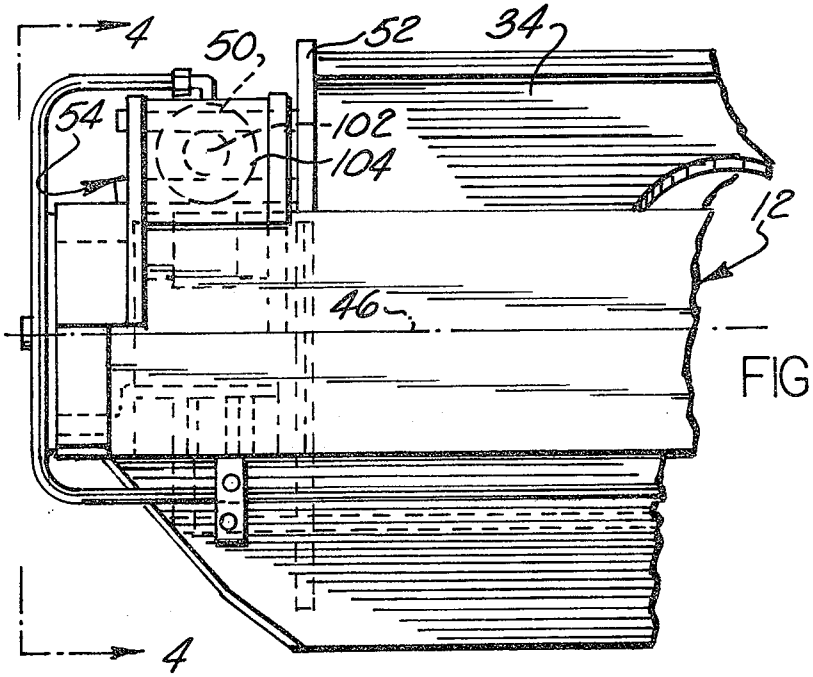
FIG. 3 is an enlarged elevational view, taken generally along the line 3—3 of FIG. 2, further illustrating the relationship between the inner end portion of the base boom section, an end portion of the cradle, the tilt motor for rotating the base boom section relative to the cradle.

A tilt or second motor 50 (see FIGS. 2 and 3) is operable to rotate the boom assembly 30 about its longitudinally extending central axis 46. The tilt motor 50 is mounted between an end wall 52 of the base boom section 34 and an upstanding portion 54 of the cradle 12. The boom assembly 30 is at least partially supported for rotational movement about its central axis 46 by a plurality or rollers 58 (FIGS. 2 and 4) disposed on a forward end portion of the cradle 12 in engagement with a circular plate 60 (FIG. 4) connected with the base boom section 34. Although only two of the rollers 58 have been shown, it should be understood that there are, in the illustrated embodiment of the invention, four rollers, which engage the plate 60 at four equally spaced apart areas. The manner in which the boom assembly 30 is supported for rotational movement about its central axis is well known and may be similar to that disclosed in U.S. Pat. Nos. 2,541,045 and 3,666,125 and will not be further described herein to avoid prolixity of description.

In accordance with one feature of the present invention, the force transmitting assembly 64 (see FIG. 5) is effective to support the inner end of the base boom section 34 for rotational movement about the central axis 46, to transmit drive forces from the tilt motor 50 to the base boom section, and to retain the base boom section against axial and radial movement relative to the cradle 12. The force transmitting assembly 64 includes a single force transmitting member 68 which is disposed in a coaxial relationship with the boom assembly 30 and is fixedly connected with the end wall 52 of the base boom section 34 by suitable bolts 74. The opposite end portion 78 of the force transmitting member 68 is engaged by a cradle mounted thrust bearing assembly 80 which holds the single force transmitting member 68 against axial and radial movement relative to the cradle 12 while enabling the force transmitting member 68 to be rotated about its central axis. The end portion 78 of the force transmitting member 68 has a circular outer surface 82 which forms a portion of a sphere and is engaged by the bearing assembly 80. The spherical outer surface 82 of the first transmitting member 68 cooperates with the bearing assembly 80 to support the force transmitting member for rotational movement about its central axis 46 and to retain the force transmitting member 68 against axial and radial movement toward either the left or the right (as viewed in FIG. 5) during operation of the material handling assembly 10.

Figure 5:
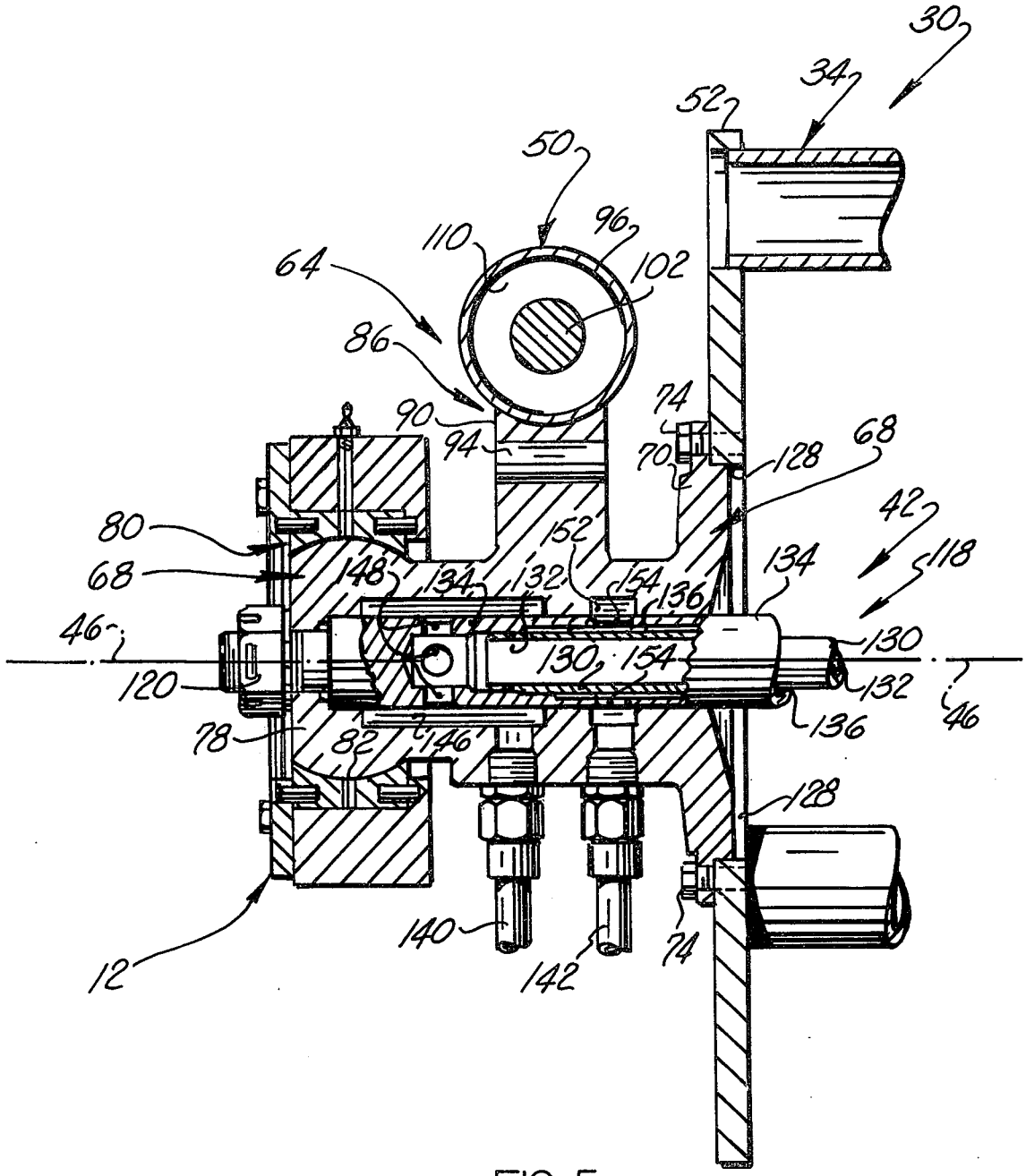
FIG. 5 is a fragmentary sectional view, taken generally along the line 5—5 of FIG. 4, illustrating the relationship between a single force transmitting member, the tilt motor, a thrust bearing mounted on the cradle, and the end wall of the base boom section.

A gear drive arrangement 86 is provided to transmit rotational forces between the tilt motor 50 and the force transmitting member 68. The gear drive arrangement 86 includes a rack gear 90 (FIGS. 4 and 5) and a pinion gear segment 94 (FIG. 5). The pinion gear segment 94 is integrally formed with a central portion of the force transmitting member 68. The rack gear 90 is fixedly connected with a cylinder 96 of the tilt motor 50.

Upon operation of the tilt motor 50, the rack gear 90 is moved toward either the left or the right (as viewed in FIG. 4) along a path extending parallel to a horizontally extending central axis of the tilt motor 50. The tilt motor 50 is of the well known piston and cylinder type and has a piston rod 102 which is fixedly connected at opposite end portions with upstanding sections 104 and 106 of the cradle end wall 54. A piston 110 (see FIG. 5) is disposed within the cylinder 96 which is coaxial with the piston rod 102. Upon porting of high pressure fluid to the left end (as viewed in FIG. 4) of the cylinder 96, the rack gear is moved toward the left along a path extending perpendicular to the boom axis 46 and parallel to the motor axis 98. This effects counterclockwise rotation (as viewed in FIG. 4) of the force transmitting member 68 to thereby rotate the boom assembly 30 in a counterclockwise direction (as viewed in FIG. 4). Similarly, upon porting of high pressure fluid to the right end (as viewed in FIG. 4) of the cylinder 96, the rack gear 90 is moved toward the right to drive the gear section 94 to effect rotation of the force transmitting member 68 and base boom section 34 in a clockwise direction.

The extension motor 42 (see FIG. 1) is operable to move the boom section 36 axially relative to the base boom section 34 to thereby extend or retract the boom assembly 30. The extension motor 34 includes a piston rod assembly 118 (FIG. 5) which is fixedly connected with the force transmitting member 68 by a suitable nut 120. The cylinder 124 (see FIG. 1) of the piston and cylinder type motor 42 is fixedly connected with the boom section 36 in the manner illustrated in U.S. Pat. No. 3,666,125. Upon porting of high pressure fluid to the outer end of the cylinder 124, the cylinder is moved axially outwardly relative to a piston (not shown) which is fixedly connected with the piston rod assembly 118. As the cylinder 124 moves axially outwardly, a boom section 36 is also moved axially outwardly to thereby extend the boom assembly 30. Similarly, upon the porting of high pressure fluid to the inner end portion of the cylinder 124, the cylinder moves axially inwardly to thereby move the boom section 36 inwardly relative to the base section 34 to retract the boom assembly 30.

It should be noted that the piston rod assembly 118 (FIG. 5) extends through a circular opening 128 in the end wall 52 of the base boom section 34 and is fixedly connected with the force transmitting member 68 independently of the base boom section. Therefore, axial forces applied to the boom section 36 and the motor 42 during operation of the material handling apparatus 10 are transmitting directly to the force transmitting member 68 and to the cradle 12 through the thrust bearing assembly 80 independently of the base boom section 34.

The piston rod assembly 118 includes a pair of coaxial tubes, that is an inner tube or rod 130 (FIG. 5) having a cylindrical central passage 132 and an outer tube or rod 134 having a cylindrical passage 136 in which the inner tube or rod 130 is disposed. The inner tube or rod 130 extends through the piston (not shown)

in the cylinder 124 of the boom extension motor 42 (see FIG. 1) so that the passage 132 is connected in fluid communication with the axially outer end portion of the cylinder 124. The outer tube or rod 134 is connected with the inner side of the piston in the cylinder 124 of the boom extension motor 42. An opening in the rod 134 adjacent to the axially inner portion of the piston connects the interior passage 136 in fluid communication with the axially inner end portion of the cylinder 124. The two concentric piston rods 130 and 134 are disposed in a coaxial relationship with the longitudinal central axis 46 of the boom assembly 30 and are held against axial movement relative to each other by a suitably bolted arrangement at the piston and the base boom section 34 by the force transmitting member 68.

In order to effect operation of the boom extension motor 42, one of the conduits 140 or 142 (see FIG. 5) is connected in communication with drain while the other conduit is connected in communication with the pump of the pump and motor assembly 20 (FIG. 1). The two conduits 140 and 142 (FIG. 5) are connected in fluid communication with the central passage 132 and 136 formed in the piston rods 130 and 134. Thus, the conduit 140 is connected in fluid communication with an annular manifold chamber 146 which circumscribes the outside of the piston rod assembly 118 and is disposed in a coaxial relationship with the piston rod 134. Radially extending passages 148 extend through the side wall of the tubular outer piston rod 134 to connect the manifold chamber 146 in fluid communication with the inner cylindrical passage 132 in the piston rod 130. Fluid from the conduit 140 flows through the manifold chamber 146 to only the passage 132. As was previously set forth, the rod passage 132 is connected in fluid communication with the head or outer end of the cylinder 124 of the extension motor 42 (see FIG. 1).

The conduit 142 is connected in fluid communication with the annular passage 136 formed between cylindrical surfaces of the piston rods 130 and 134. Thus, an annular manifold chamber or ring 152 (FIG. 5) is connected in fluid communication with the conduit 142 and with radial passages 154 and 156 extending from the outer surface of the piston rod 134 to the passage 136. Therefore, fluid from the conduit 142 can flow through the manifold ring 152 and the passages 154 to the passage 136 between the inner and outer piston rods 130 and 134. It should be noted that a connection between the piston rods 130 and 134 blocks fluid communication between the passage 132 and the passage 136. As was previously set forth, the rod passage 132 is connected in fluid communication with the outer or head end of the piston in the cylinder 124.

When the boom section 36 is to be moved axially outwardly relative to the boom section 34, a suitable control valve (not shown) is actuated to connect the conduit 142 with the pump in the pump and motor assembly 20. High pressure fluid from the conduit 140 flows from the manifold ring 146 through the passages 148 to the rod passage 132. Since the passage 132 is connected in fluid communication with the head end of the cylinder 124, the high pressure fluid causes the cylinder 124 and the boom section 36 to move axially outwardly relative to the base boom section 34. As this is occurring, fluid is exhausted from the rod end of the cylinder 124 through the passage 136 to the manifold ring 152 and the conduit 142 which is connected with drain. The thrust forces applied to the piston rod 118 during extension of the motor 42 and boom section 36 are transmitted directly to the force transmitting member 68 and the cradle 12 independently of the base boom section 34.

When the motor 42 is to be retracted to increase the telescopic relationship between the boom section 36 and the base boom section 34, the conduit 142 is connected with a source of high pressure fluid which flows from the manifold ring 152 through the passages 154 to the rod passage 136 within the outer piston rod 134. Since the passage 136 is connected in fluid communication with the rod end of the cylinder 124, the cylinder 124 moves axially inwardly relative to the base boom section 34 to retract the boom assembly 30. As this occurs, fluid is exhausted from the head end of the cylinder 124 through the inner rod passage 132 to the radial passages 148, manifold ring 146 and the conduit 140 which is connected with drain. It should be noted that as the boom section 36 is retracted, the thrust member 68 holds the piston rod 134 against axial movement independently of the base boom section 34. Thus, the thrust forces applied to the piston rod 134 are transmitted directly to the cradle 12 from the force transmitting member 68 through the thrust bearing assembly 80.

In view of the foregoing description, it can be seen that the material handling apparatus 20 includes a boom assembly 30 having a rotatable base boom section 34 in which a second boom section 36 is telescopically received so that both boom sections are simultaneously rotated about their common central axes by a tilt or rotational drive motor 50. Drive forces are transmitted from the tilt motor 50 to the base boom section by a force transmitting assembly 64 which is also effective to retain the base boom section against axial movement relative to a cradle 12 which supports the boom assembly 30. The force transmitting assembly 64 includes a single member 68 which transmits axial, thrust and radial forces and rotational drive forces.

The single force transmitting member 68 is fixedly connected at one end 70 to an inner end wall 52 of the base boom section 34 and is rotatably mounted at its opposite end 78 on a cradle mounted thrust bearing 80. The piston and cylinder type tilt motor 50 is disposed between the end wall 52 of the base boom section and the cradle 12. The tilt motor 50 is operable to rotate the single force transmitting member 68 to thereby rotate the base boom section 34. The single force transmitting member 68 is provided with internal passages or chamber 146 and 152 to direct fluid for effecting operation of the boom extension motor 42 to move the second boom section 36 telescopically in and out relative to the base boom section to thereby vary the overall length of the boom assembly.

Having described one specific preferred embodiment of the invention, the following is claimed:

1. A material handling apparatus comprising a base, a longitudinally extending first boom section having axially inner and outer end portions, said outer end portion of said first boom section including surface means for defining a first opening, said inner end portion of said first boom section including surface means for defining a second opening, a second boom section telescopically disposed within said first boom section and extending through said first opening, cradle means connected with said base for supporting said first and second boom sections, said cradle means including a longitudinally extending body which at least partially defines a cavity for receiving said first boom section and an end portion connected with said body to at least partially define one end of said cavity, said inner end portion of said first boom section being disposed adjacent to said end portion of said cradle means, first motor means for effecting axial movement between said first and second boom sections to vary the telescopic relationship between said boom sections, said first motor means being connected with said end portion of said cradle means and extending through said second opening in said first boom section into engagement with said second boom section to transmit axial thrust forces between said second boom section and said cradle means independently of said first boom section, and second motor means disposed between said inner end portion of said first boom section and said end portion of said cradle means for effecting rotational movement of said first and second boom sections relative to said cradle means.

2. An apparatus as set forth in claim 1 wherein said first motor means includes a piston and cylinder assembly disposed in a coaxial relationship with said first and second boom sections, said second motor means including a second piston and cylinder assembly having a central axis which extends transversely to the longitudinal axes of said first and second boom sections.

3. An apparatus as set forth in claim 1 further including gear means disposed between said inner end portion of said first boom section and said end portion of said cradle means for transmitting drive forces from said second motor means to said first boom section.

4. A material handling apparatus comprising a base, a longitudinally extending first boom section having axially inner and outer end portions, said outer end portion of said first boom section including surface means for defining a first opening, a second boom section telescopically disposed within said first boom section and extending through said first opening, cradle means connected with said base for supporting said first and second boom sections, said cradle means including a longitudinally extending body which at least partially defines a cavity for receiving said first boom section and an end portion connected with said body to at least partially define one end of said cavity, said inner end portion of said first boom section being disposed adjacent to and spaced apart from said end portion of said cradle means, first motor means for effecting axial movement between said first and second boom sections to vary the telescopic relationship between said boom sections, said first motor means being connected with said end portion of said cradle means and with said second boom section to transmit axial thrust forces between said second boom section and said cradle means, a rotatable member extending between said inner end portion of said first boom section and said end portion of said cradle means, bearing means connected with said member and said end portion of said cradle means for supporting said member for rotation relative to said cradle means, connector means for connecting said member with said inner end portion of said first boom section and for preventing relative rotation between said member and said first boom section, second motor means disposed between said inner end portion of said first boom section and said end portion of said cradle means, and gear means disposed between said inner end portion of said first boom section and said end portion of said cradle means for transmitting drive forces from said second motor means to said member to effect rotation of said member and said first and second boom sections relative to said cradle means under the influence of said second motor means.

5. An apparatus as set forth in claim 4 wherein said second motor means includes a piston and cylinder assembly disposed between said inner end portion of said first boom and said end portion of said cradle means.

6. An apparatus as set forth in claim 5 wherein said first motor means includes a second piston and cylinder assembly connected with said second boom section and said member.

7. An apparatus as set forth in claim 5 wherein said inner end portion of said first boom section includes surface means for defining a second opening, said second motor means extending through said second opening to transmit axial thrust forces between said second boom section and said cradle means independently of said first boom section.

8. A material handling apparatus comprising a base, a longitudinally extending first boom section having axially inner and outer end portions, said outer end portion of said first boom section including surface means for defining a first opening, a second boom section telescopically disposed within said first boom section and extending through said first opening, cradle means connected with said base for supporting said first and second boom sections, said cradle means including a longitudinally extending body which at least partially defines a cavity for receiving said first boom section and an end portion connected with said body to at least partially define one end of said cavity, said inner end portion of said first boom section being disposed adjacent to said end portion of said cradle means, first motor means for effecting axial movement between said first and second boom sections to vary the telescopic relationship between said boom sections, said first motor means being connected with said end portion of said cradle means and with said second boom section to transmit axial thrust forces between said second boom section and to said cradle means, said first motor means including a first piston and cylinder assembly having a longitudinal axis extending parallel to longitudinal central axes of said first and second boom sections, and second motor means disposed between said inner end portion of said first boom section and said end portion of said cradle means for effecting rotational movement of said first and second boom sections relative to said cradle means, said second motor means including a second piston and cylinder assembly having a longitudinal axis extending perpendicular to the longitudinal axis of said first piston and cylinder assembly.

* * * * *